US008903113B2

(12) United States Patent
Gebert

(10) Patent No.: US 8,903,113 B2
(45) Date of Patent: Dec. 2, 2014

(54) INFLATABLE EAR MOLD WITH PROTECTED INFLATION AIR INLET

(75) Inventor: Anton Gebert, Kleinsendelbach (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 13/809,793

(22) PCT Filed: Apr. 8, 2011

(86) PCT No.: PCT/EP2011/055520

§ 371 (c)(1),
(2), (4) Date: Jan. 11, 2013

(87) PCT Pub. No.: WO2012/007193

PCT Pub. Date: Jan. 19, 2012

(65) Prior Publication Data

US 2013/0114839 A1 May 9, 2013

Related U.S. Application Data

(60) Provisional application No. 61/363,814, filed on Jul. 13, 2010, provisional application No. 61/385,635, filed on Sep. 23, 2010.

(51) Int. Cl.
*H04R 25/00* (2006.01)

(52) U.S. Cl.
USPC ..... 381/328; 381/322

(58) Field of Classification Search
CPC ..... H04R 25/00; H04R 25/55; H04R 25/558; H04R 2225/023; H04R 2225/025; H04R 1/105; H04R 2225/021; H04R 2225/63
USPC ..... 381/315, 322, 327–328, 330
See application file for complete search history.

(56) References Cited

U.S. PATENT DOCUMENTS

| | | | | |
|---|---|---|---|---|
| 4,133,984 | A | 1/1979 | Akiyama | |
| 4,834,211 | A | 5/1989 | Bibby et al. | |
| 7,227,968 | B2 | 6/2007 | van Halteren et al. | |
| 7,425,196 | B2 | 9/2008 | Jorgensen et al. | |
| 8,391,534 | B2 * | 3/2013 | Ambrose et al. | 381/380 |
| 8,526,652 | B2 * | 9/2013 | Ambrose et al. | 381/328 |

(Continued)

FOREIGN PATENT DOCUMENTS

| | | | |
|---|---|---|---|
| DE | 2 737 252 | A1 | 3/1978 |
| WO | 2010/094034 | A1 | 8/2010 |

*Primary Examiner* — Suhan Ni
(74) *Attorney, Agent, or Firm* — Laurence A. Greenberg; Werner H. Stemer; Ralph E. Locher

(57) ABSTRACT

An ear piece is formed for insertion and placement in an external auditory canal. The ear piece has an inflatable which, when it is inflated, expands and braces against the walls of the auditory canal. When it is deflated, it may be withdrawn from the auditory canal. The ear piece may be used in connection with a hearing aid, an MP3 player, a cell phone, or the like. A pump is provided for inflating the balloon and a valve may be controlled for selectively deflating the balloon. The air intake to the pump is disposed so as to be protected against contamination from inside the auditory canal. For that purpose it is formed inside a housing the air inlet of which is as far outside the ear canal as possible. In the case of a behind-the-ear application, the intake opening is formed in the housing that is to be placed behind the user's ear.

10 Claims, 4 Drawing Sheets

(56) References Cited

U.S. PATENT DOCUMENTS

2009/0023976 A1 1/2009 Cho et al.
2010/0002897 A1 1/2010 Keady
2012/0101514 A1 4/2012 Keady et al.

* cited by examiner

INFLATABLE EAR MOLD WITH PROTECTED INFLATION AIR INLET

BACKGROUND OF THE INVENTION

Field of the Invention

The invention relates to a hearing device, such as a hearing aid, with an inflatable ear mold or an ear piece with an inflatable balloon and a housing with the components for the generation and delivery of sound and/or inflation pressure to the ear mold.

Along with the ever-increasing miniaturization of electronic devices and the increasing prevalence of audiological devices that require direct delivery of sound to the human ear, there is a desire to provide ever smaller devices that may be placed in the auditory canal of a user.

For example, hearing devices are wearable hearing apparatuses which are used to supply the hard-of-hearing. A variety of different configurations of hearing devices are known, such as, for example, behind-the-ear hearing devices (BTE), hearing device with an external receiver (RIC: receiver in the canal) and in-the-ear hearing devices (ITE), e.g. also concha hearing devices or canal hearing devices (ITE—in-the-ear, CIC—completely in the canal). Similarly, headphones for the personal delivery of auditory materials have recently become more miniaturized and they have progressed to very small ear-buds with in-the-canal speakers.

Primarily important components of a hearing device include an input converter (e.g., a microphone), an amplifier, and an output converter. In the case of a sound player (e.g., an MP3 player), the signal originating from a memory is amplified and fed to the output converter. Typically, the output converter in an electroacoustic converter (e.g., a miniature loudspeaker, bone transducer) which converts the electrical signal into a mechanical vibration. In the case of a loudspeaker, the vibration is converted to longitudinal pressure waves which impinge on the tympanic membrane of the user. There, the sound waves are converted into neurological signals which are fed to the brain, where they are decoded for content.

U.S. Pat. No. 7,227,968 B2 describes a two-part hearing aid in which the receiver, which is separate from the remaining components, may be inserted deep into the auditory canal. The receiver houses a speaker, which is driven by way of an electrical connection through the canal. The receiver housing is surrounded by an inflatable soft shell, which, when inflated and thus expanded, fixes the receiver in position in the auditory canal. Similarly, U.S. Pat. No. 7,425,196 B2 also describes a receiver module for a hearing aid that may be positioned deep in the auditory canal. The receiver housing is surrounded by an expandable material, which may be expanded against the walls of the canal.

The prior art devices are not particularly selective with regard to the source of inflation air or fluid. Specifically, the prior art usually inflates by aspirating directly into the inflation pump and/or with air from inside the ear canal. The ear canal, however, is typically contaminated by cerumen, flaking particles, greasy fumes and the air has a high moisture content. This is harmful to the functioning of the pump system, as it is often responsible for the high failure rate of the receiver.

BRIEF SUMMARY OF THE INVENTION

It is an object of the invention to provide a hearing device with an inflatable ear piece, which overcomes a variety of disadvantages of the heretofore-known devices and methods of this general type and which provides for an inflatable device in which the pump is assured to be supplied with relatively uncontaminated air, for example, by taking the air from the outside as opposed to from the inside of the ear canal and thus avoids the potential contamination that may be harmful for the functioning of the pump system. Furthermore, it is an object of the invention to provide a system with extra filtering of the air intake.

With the foregoing and other objects in view there is provided, in accordance with the invention, a hearing device, comprising:

an inflatable balloon sealingly mounted on a carrier, the carrier and the balloon forming a unit configured for insertion into an auditory canal of a hearing device user;

a receiver module for generating an audible sound signal to be delivered in the auditory canal;

a pressure source fluidically connected through the carrier to an interior space of the inflatable balloon for selectively inflating the balloon; and an intake opening connected to the pressure source and enabling aspiration of a pressure medium by the pressure source, wherein the intake opening is disposed inside a housing and the housing is formed with an inlet for aspiration of the pressure medium from outside the auditory canal of the hearing device user.

By placing the intake opening to the pressure source (i.e., pump, valve) inside a housing and, further, by placing the air inlet into the housing facing outward of the ear canal or outside the ear canal altogether, any contamination of the pump and the valve, as well as the pump supply system, is safely prevented. The housing surrounding the air inlet into the duct forms a plenum, or an antechamber, as it were, in which any unwanted particulate matter may be deposited instead of being aspirated into the pump system.

In accordance with an added feature of the invention, a filter may be disposed between the pressure source and the inlet. The filter is preferably a replaceable filter disposed at the intake opening or at any location which allows it to be replaced. The filter may be, for example, a foam filter or filter membrane.

In accordance with an added feature of the invention, the housing is a housing of an in-the-ear or a completely-in-the-canal hearing device containing the pressure source and the intake opening, and having a wall facing toward an outside of the auditory canal formed with the inlet for aspiration of air from outside the auditory canal. This placement of the inlet—as far outside and away from the potential source of contamination—prevents any possibility of unwanted contamination.

In the alternative, the housing is a housing of a behind-the-ear hearing device and the housing is connected in fluid-tight connection with the pressure source. It is possible, in this embodiment, to dispose the pressure source in the ear mold or even in the behind-the-ear housing. When the pressure source and the intake opening are disposed in the BTE housing and the inlet for aspiration of air is formed in the housing to be placed behind the ear of the hearing device user, there is provided a pressure tube from the housing to the ear mold. A flexible tube connects the BTE housing to the ear mold (i.e., the carrier and the balloon).

The flexible tube forms a supply tube from the pressure source disposed in the housing or, in the alternative, a pressure supply tube may run inside the flexible tube between the pressure source and the carrier. Preferably, the pressure source is an electrically operated pump, which also includes a controllable valve for selectively sealing an interior of the balloon or allowing the balloon to become deflated.

In accordance with a concomitant feature of the invention, the hearing device is embodied as a hearing aid. The hearing aid may be any from the group of a behind-the-ear (BTE) hearing aid, an in-the-ear (ITE) hearing aid, a concha hearing aid, an in-the-canal (ITC) hearing aid, or a completely-in-the-canal (CIC) hearing unit. In each case, the inlet into the housing for aspiration of air from inside the housing and into the pump for inflating the balloon is formed at a location outside of the auditory canal, or as far outside as possible, and distally from said balloon.

The invention prevents blocking of the air ingress of an inflatable pump-balloon system and also soiling of the pump itself. The inflatable acoustic seal consists of several key components, namely, a motor to deliver the mechanical energy for the pump (for example an electro-magnetic receiver), a pump/valve, and an interface to connect the balloon (which contains the delivery channel (s) for pressurized air/gas and the sound channel. The invention is primarily concerned with avoiding failure with regard to this system and to provide an appropriate configuration of the air/gas ingress channel and port.

To summarize once more, in order to prevent blocking of the air ingress channels, the entry port is located inside a larger structure. The larger structure, which may be the hearing aid housing, provides an intake plenum. The hearing aid housing thereby may be an ITE or BTE style design. The housing acts like an mechanical air filter and prevents that the ingress port may be touched. That is, the placement of the intake entry port into pump ensures that the air is prefiltered, that the intake port cannot be touched or otherwise obstructed, and that the pump aspirates air from the outside and not from the inside of the ear canal, which is quite considerably contaminated (i.e., cerumen, flaking particles, greasy fumes, and high moisture content).

In addition, the extra filter at the entry port of the air intake channel may be placed so as to be replaced by the user, as easily and simply as replacing the battery.

The placement and fixation of the respective devices by way of otoplastic materials need not be described in further detail. Those of skill in the art of hearing devices are quite familiar with the pertinent technology and are able to configure the respective system according to the specific requirements.

The invention is not limited to the combined assembly including the entire hearing device, or a complete hearing aid, but it is also directed separately to a balloon module and to a receiver module each to be used in connection with the hearing device. Other features which are considered as characteristic for the invention are set forth in the appended claims.

Although the invention is illustrated and described herein as embodied in an inflatable ear piece to be inserted into an auditory canal, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DETAILED DESCRIPTION OF THE INVENTION

Figure 1:
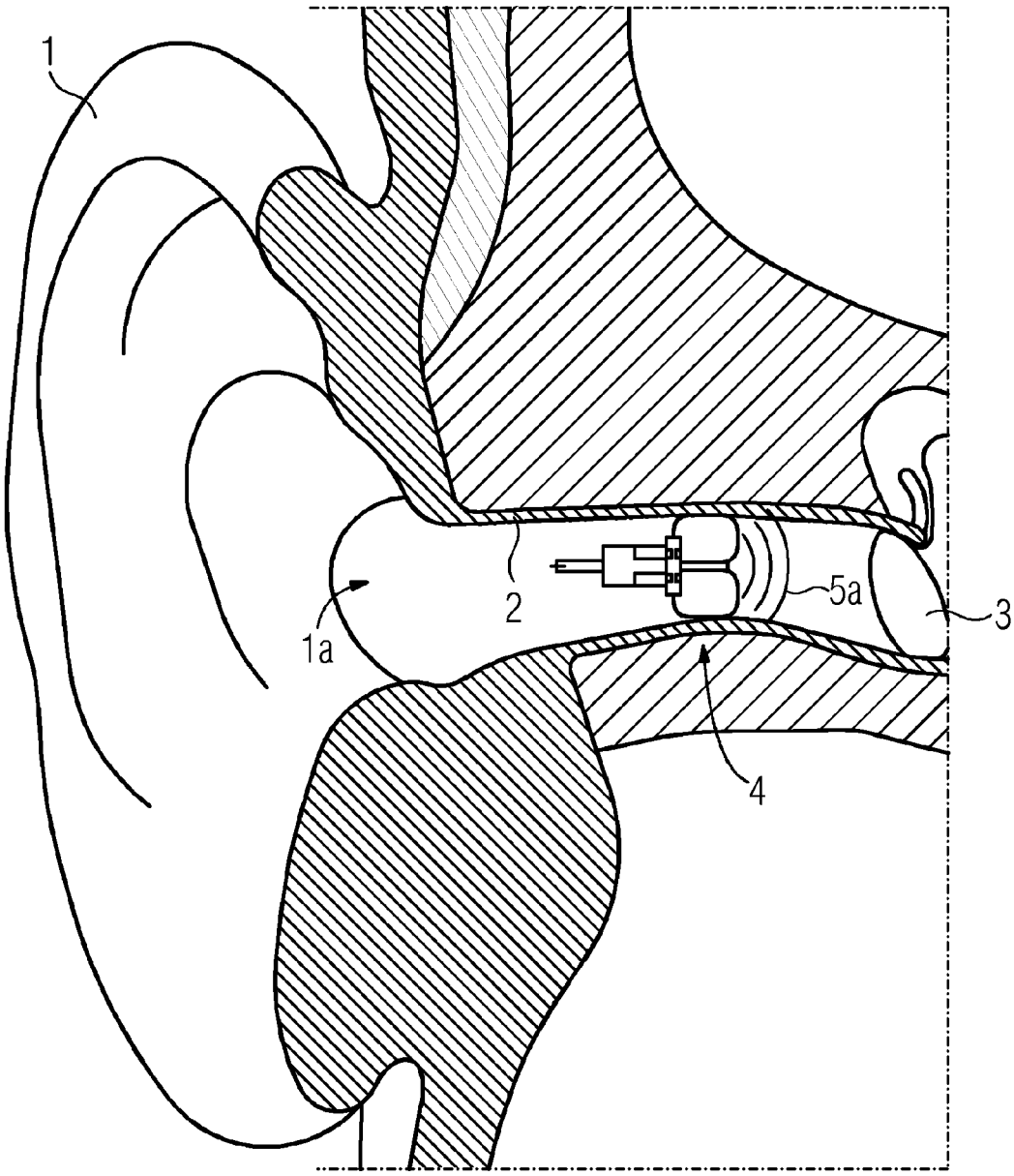
FIG. 1 is a schematic view of an outer ear with an auditory canal leading to an ear drum and an inflatable ear mold inserted into the canal.

Referring now to the figures of the drawing in detail and first, particularly, to FIG. 1 thereof, there is seen a human ear 1 and an external auditory canal 2. The auditory canal is bounded by a tympanic membrane 3, also referred to as an eardrum. In unassisted hearing, pressure waves (sound waves are longitudinal pressure waves) are funneled at the concha 1*a* of the ear 1, they travel through the external auditory canal 2, also referred to as the ear canal or, simply canal, before they impinge on the tympanic membrane 3.

In assisted hearing, such as with hearing aids or ear pieces of sound players or cell phones, the propagation of the sound waves through the auditory canal 2 may be interrupted. The sound waves are instead picked up by a microphone or the like, the resulting signal is processed, typically by way of digital signal processing, and the processed signal is utilized to excite a loudspeaker, typically in the vicinity of or at the tympanic membrane 3. In the case of ear buds for music or telephony, the sound waves are directly injected at the concha 1*a* for delivery through the auditory canal 2.

Figure 2:
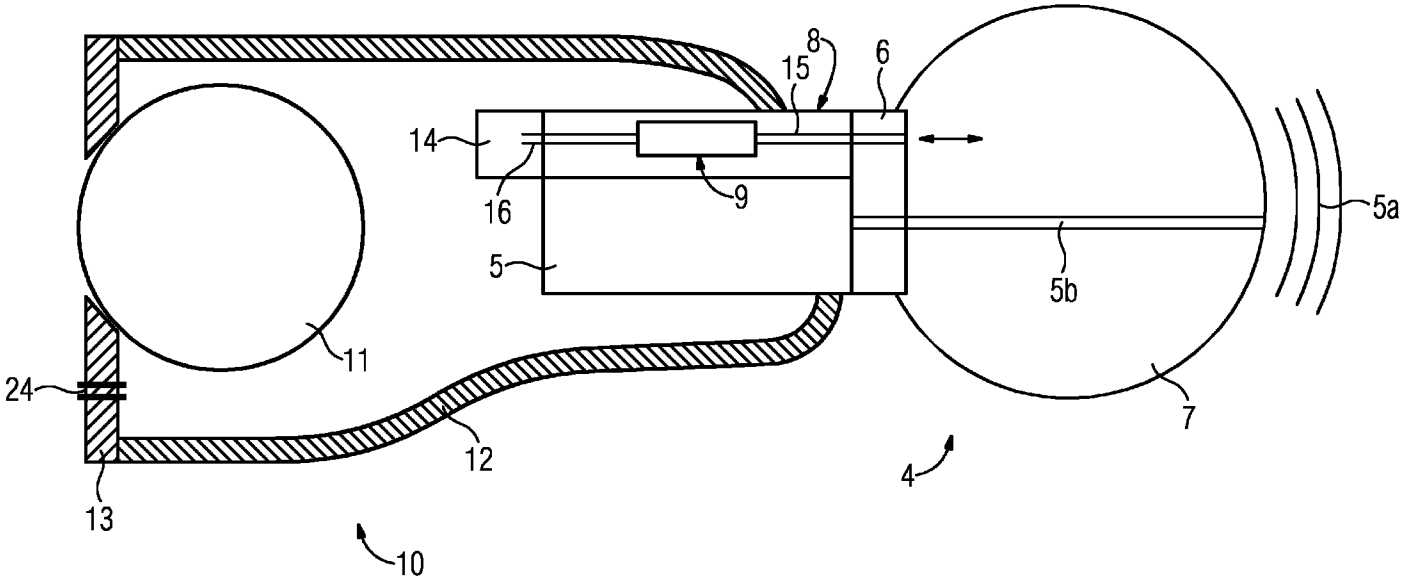
FIG. 2 is a schematic longitudinal section taken through an in-the-ear (ITE) hearing device.

Referring now to FIG. 2 in connection with FIG. 1, an ear piece 4 according to the invention is formed in a unitary construction with a hearing device 10. That is, there is shown here a hearing aid in the form of an in-the-ear (ITE) unit or a completely-in-the-canal (CIC) hearing unit. A receiver module 5 connects to a carrier module 6, also referred to as a carrier 6, which, in turn, carries an inflatable member 7. The inflatable member 7 is a balloon or a bag or an accordion-type bellows. While we may simply refer to the inflatable member as a balloon 7, the term "balloon" should be understood in its broadest sense as any inflatable member. It may be in the form of a balloon with resiliently stretchable material, or a bag, or an accordion-type bellows with folded/crimped balloon shapes. Further the material is chosen such that it provides a pleasant haptic feel as it is pressed against the wall of the ear canal 2 and, once inflated, does not shift relative to the canal 2. The balloon 7 is formed of a flexible material which is impermeable to cerumen, or ear-wax, and also to water. The balloon 7 is preferably formed of silicone or latex, or any of the known flexible materials that are used for otoplasties and other cavity-insertible products known, especially, in the hearing aid arts. It may further be covered on the laterally outside walls, i.e., the walls that are braced into contact with the walls of the ear canal 2, with a soft silicone or rubber material layer.

As illustrated here, the balloon 7 resembles a tubeless tire, that is, it is sealed against the rim of the carrier 6 and, upon inflation, it forms a doughnut-shaped thoroid fluid space. The receiver module 5 carries one or two pumps 8 forming the compressed air sources for inflating the balloon 7. The pumps 8 are fully integrated in and form a part of the receiver module 5. It is also possible, however, for the pumps 8 to be fixedly mounted to (or, integrated with) the carrier 6. In this case, the carrier 6 and the pumps 8 may be removed together from the receiver module 5 in order to exchange the inflatable member (i.e., the carrier and the balloon). These two variants of the interface, therefore, enable the balloon 7 to be removed from the receiver-pump combination or the balloon and the pump combination to be removed from the receiver. There is also provided a valve 9 for enabling the balloon 7 to be deflated, for removal or simply to alleviate the occlusion afforded by the earpiece 4. The valve 9 may be provided in the pump(s) 8 or in the pneumatic line traversing the interface, i.e., the carrier 6. The pressurization and the deflation of the balloon are schematically indicated by the two-way arrow at the air inlet into the balloon 7.

The receiver module 5 contains the necessary electronics for generating a speaker signal for conversion to sound waves at the forward end of the inflatable ear mold and for delivery to the tympanic membrane 3. As illustrated, the forward end of the receiver 5 may be formed with a sound opening through which the sound waves 5*a* are delivered in the direction toward the ear drum 3. There is also provided a through-bore through the carrier 6 as well and, possibly, a funnel pipe to deliver the sound toward and past the forward end of the balloon 7. In the completely autonomous embodiment of the ITE application illustrated in FIG. 2, the sound signal is generated in the receiver module 5. The necessary power is sup-plied from a battery 11 inside the insertible housing 12 of the device 10. The housing 12, which is also formed with an access door 13 (e.g., for exchanging the battery 11, or the filter 14), is formed of conventional otoplastic materials, as they are well known in the hearing aid art.

The battery 11 also provides the necessary power for the pump 8 and, if necessary, for the valve 9. The pump 8 pumps the air for inflating the balloon 7 through an air supply duct 15, which extends from an air intake opening 16 to the air inlet into the balloon 7. The valve 9 is disposed inline in the duct 15. The valve 9 enables selective closing of the duct and thus pneumatic sealing of the interior of the balloon 7. The air intake opening 16 and the inlet into the duct 15 are preferably covered by an extra filter 14, which may be a foam filter or a filter membrane. The filter 14 may be removable and exchangeable by the user or by an audiologist. The air intake is thus protected against the rather contaminated environment in the ear canal (i.e., against cerumen, flaking particles, greasy fumes, moisture, etc.) in that the air is aspirated through or at the cover lid 13. The latter is exposed to the outside of the ear, or it is placed in the concha, with free access "clean" inflation air.

The receiver module 5 in FIG. 2 generates the necessary sound signal directly. The required microphone and the electrical connection to the battery and the microphone are not illustrated, so as not to unnecessarily complicate the description. In the following embodiments, the receiver module 5 receives its information signal from an external assembly through a signal line 17. That is, the ear piece (IEM, insertable ear mold) may be tethered to an external assembly in the form of a behind-the-ear (BTE) unit or a concha unit.

Figure 3:
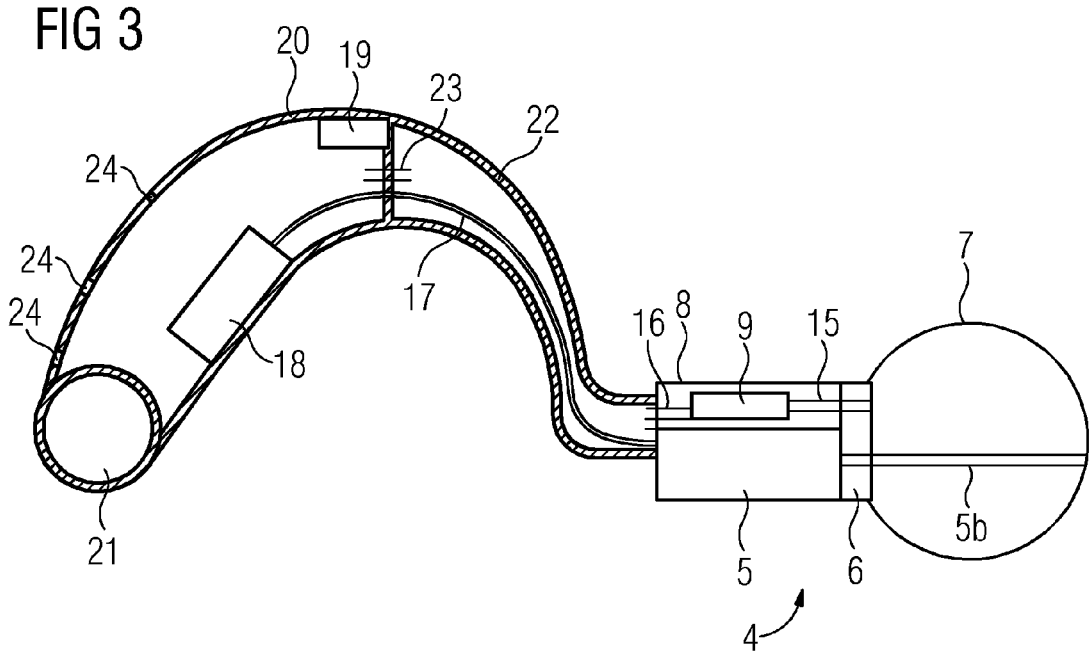
FIG. 3 is a schematic longitudinal section taken through an inflatable ear mold in combination with a behind-the-ear (BTE) hearing unit.

Referring now to FIG. 3, there is shown an embodiment of the invention with an inflatable ear mold, i.e., a receiver in the canal, and a behind-the-ear (BTE) hearing unit. Here, the receiver 5 is connected by way of an electrical signal line 17 to an amplifier 18, which generates the necessary signals for presentation to the ear drum 3. The ambient sound is picked up through one or more microphones 19 strategically disposed on the housing 20 of the BTE unit. The amplifier and all other electronic devices in the housing, as well as in the receiver (e.g., speaker, pump, valve), are supplied with energy from a battery (BAT) 21. The various electrical connections inside the housing 20 are not illustrated so as not to unnecessarily complicate the description. The housing 20 is connected to the receiver module 5 by way of tubing 22.

Air for inflating the balloon 7 by way of the pump 8 is aspirated through the tubing 22, which is sealed in an air-tight manner to the air intake 16, on the one hand, and to the housing 20, on the other hand. The tubing 22 is sealed at an air duct 23 formed in the housing 20, so that the air is aspirated from the BTE housing 20. For that purpose, the housing 20 is formed with air intake openings 24, or an air grill or the like. If desired, an air filter may be strategically disposed at the intake openings 24 or at the air duct 20. Since the sound signal traverses the tubing by way of the cables 17, i.e., in the form of an electrical signal, a filter may also be inserted in the tubing or at the interface between the tubing 22 and the housing 20. Such a filter is then easily exchanged, either by the user or by an audiologist.

Figure 4:
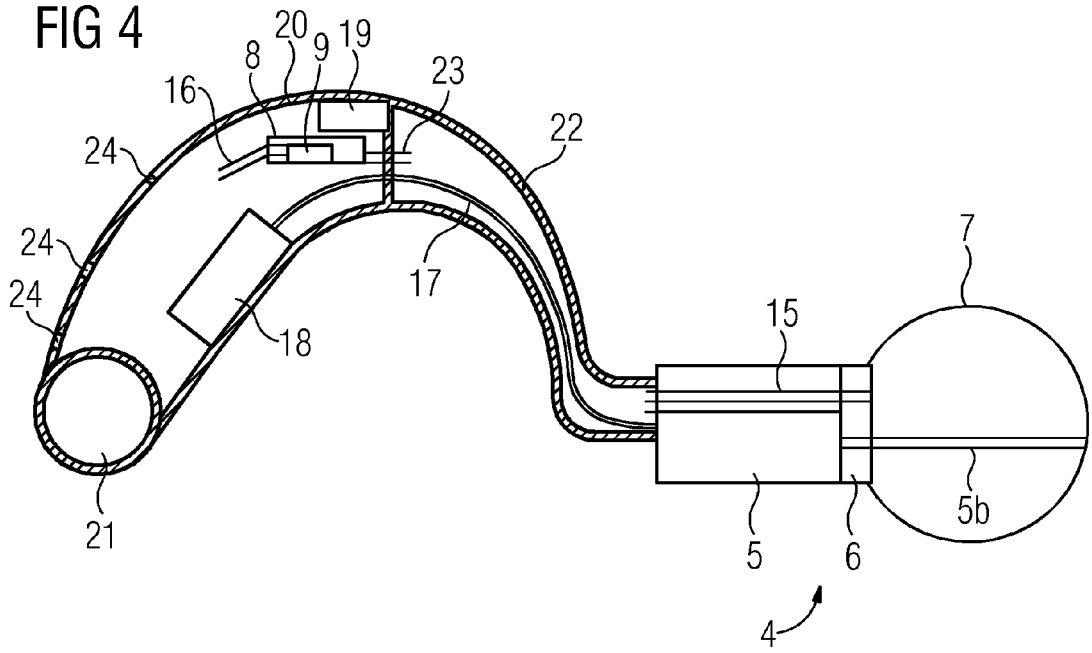
FIG. 4 is a schematic longitudinal section taken through an alternative embodiment of a behind-the-ear hearing unit with an inflation pump in the behind-the-ear housing.

Referring now to FIG. 4, a further alternative embodiment of a behind-the-ear (BTE) hearing aid has the pump 8 and the valve 9 disposed in the housing 20 instead of in the ear mold. Here, again, the tubing is sealed air-tight or fluid-tight between the receiver 5 and the housing 20 and, more particularly, the pump 8 and valve 9. The pump 8 aspirates air from inside the housing 20 and the housing 20 is formed with air intake openings 24. If desired, a filter 14 may be provided, either at the intake opening of the pump 8 or at the intake and air ingress openings 24.

Figure 5:
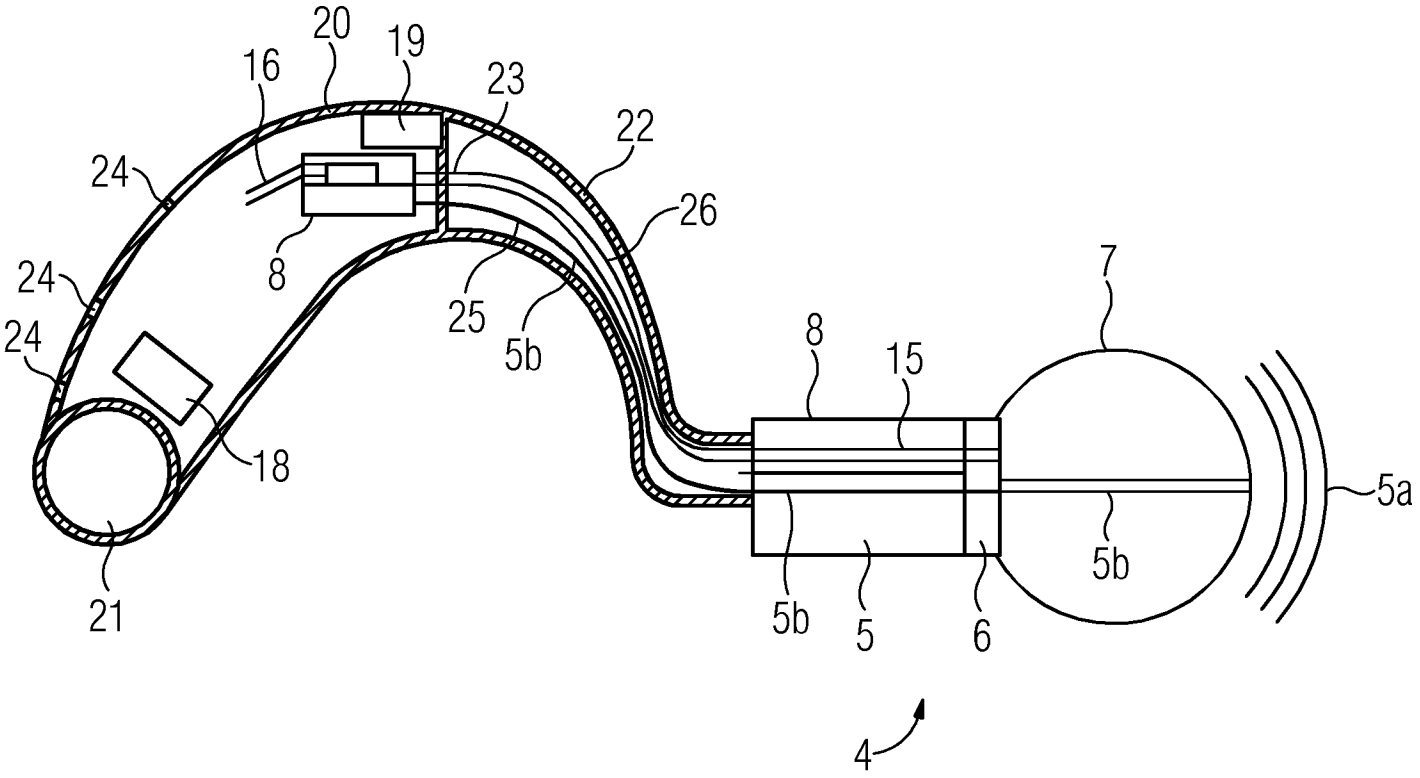
FIG. 5 is a schematic longitudinal section taken through a further variation of the behind-the-ear (BTE) hearing unit with an inflation pump and a receiver in the behind-the-ear housing.

Referring now to FIG. 5, it is also possible, according to a further variant, to place all of the electronics, including the receiver 5, in the housing. In this case, the sound is generated inside the housing, and travels to and through the balloon module via a sound tube 25. That is, the sound waves 5*b* are delivered through the sound tube 5*b* from the receiver 5, inside the tubing 22 which acts as a sheath, and through the ear mold 4, where the sound waves 5*a* issue towards the ear drum 3. The inflation air from the pump 8 may be delivered via a pressure hose 26, as illustrated in FIG. 5. It may also be delivered, as in FIG. 4, through the tubing 22. In the former case, it is not necessary to connect the housing 20 to the ear mold in a fluid-tight manner.

The invention claimed is:

1. A hearing device, comprising:

an inflatable balloon sealingly mounted on a carrier, said carrier and said balloon forming a unit configured for insertion into an auditory canal of a hearing device user;

a receiver module for generating an audible sound signal to be delivered in the auditory canal;

a pressure source fluidically connected through said carrier to an interior space of said inflatable balloon for selectively inflating said balloon; and an intake opening connected to said pressure source and enabling aspiration of a pressure medium by said pressure source, wherein said intake opening is disposed inside a housing and said housing is formed with an inlet for aspiration of the pressure medium from outside the auditory canal of the hearing device user;

wherein said housing is a housing of a behind-the-ear hearing device and said pressure source is disposed in said housing;

a flexible tube connecting said housing to said carrier and said balloon, said flexible tube forming a supply tube from said pressure source disposed in said housing or a pressure supply tube extending inside said flexible tube between said pressure source and said carrier.

2. The hearing device according to claim 1, which further comprises a filter disposed between said pressure source and said inlet.

3. The hearing device according to claim 2, wherein said filter is a replaceable filter disposed at said intake opening.

4. The hearing device according to claim 1, wherein said pressure source and said intake opening are disposed in said housing and said inlet for aspiration of air is formed in said housing so as to be placed behind an ear of the hearing device user.

5. The hearing device according to claim 1, wherein said pressure source is an electrically operated pump.

6. The hearing device according to claim 1, which comprises a controllable valve for selectively sealing an interior of said balloon or allowing said balloon to become deflated.

7. The hearing device according to claim 1, wherein said pressure source is at least one pump integrally formed with said receiver and further having a controllable valve fluidically connected to an interior of said balloon.

8. The hearing device according to claim 1, wherein said pressure source is a pump assembly comprising an air pump for inflating said balloon and a deflation valve for deflating said balloon.

9. The hearing device according to claim 1, wherein said receiver is connected by way of a signal line to a device for delivering electronic signals for processing in said receiver.

10. The hearing device according to claim 1 embodied as a hearing aid.

* * * * *